US005991918A

United States Patent [19]

Choate

[11] Patent Number: 5,991,918

[45] Date of Patent: Nov. 30, 1999

[54] BARBER'S PROTECTIVE RING

[76] Inventor: Brian W. Choate, 6159 W. Dakin St., Chicago, Ill. 60634

[21] Appl. No.: 09/211,265

[22] Filed: Dec. 14, 1998

[51] Int. Cl.[6] ..... A41D 13/00

[52] U.S. Cl. ..... 2/21; 2/163; 132/213.1

[58] Field of Search ..... 2/21, 163; 132/213, 132/213.1, 214; 602/22

[56] References Cited

U.S. PATENT DOCUMENTS

| | | | |
|---|---|---|---|
| 496,520 | 5/1893 | Lord | 2/21 |
| 1,115,619 | 11/1914 | Tsukamoto | 30/298 |
| 4,269,205 | 5/1981 | Clark et al. | 132/45 |
| 4,704,742 | 11/1987 | Foster | 2/21 |
| 4,845,777 | 7/1989 | Mersinas | 2/21 |
| 5,520,626 | 5/1996 | Schaeffer | 602/22 |

FOREIGN PATENT DOCUMENTS

| | | | |
|---|---|---|---|
| 2183990 | 6/1987 | United Kingdom | 2/21 |

*Primary Examiner*—Diana Oleksa
*Assistant Examiner*—Kate Moran
*Attorney, Agent, or Firm*—Lee, Mann, Smith, McWilliams, Sweeney & Ohlson

[57] ABSTRACT

A barber's guard ring for protecting portions of his hand from scissortip cuts is disclosed. The ring comprises a band portion which is adapted to be worn on the barber's central finger adjacent the base of that finger and the metacarpal body of his hand. The ring also includes at least one protective flange. A first end section of the flange is connected to the band portion. A body section of the flange is connected to the first end section and overlies a portion of the barber's central finger and also a portion of his neighboring finger. And a second end section of the flange is connected to the body section. The second end section has an outside surface which is spaced apart from the metacarpal knuckles of his central finger and the neighboring finger.

11 Claims, 2 Drawing Sheets

FIG. 3
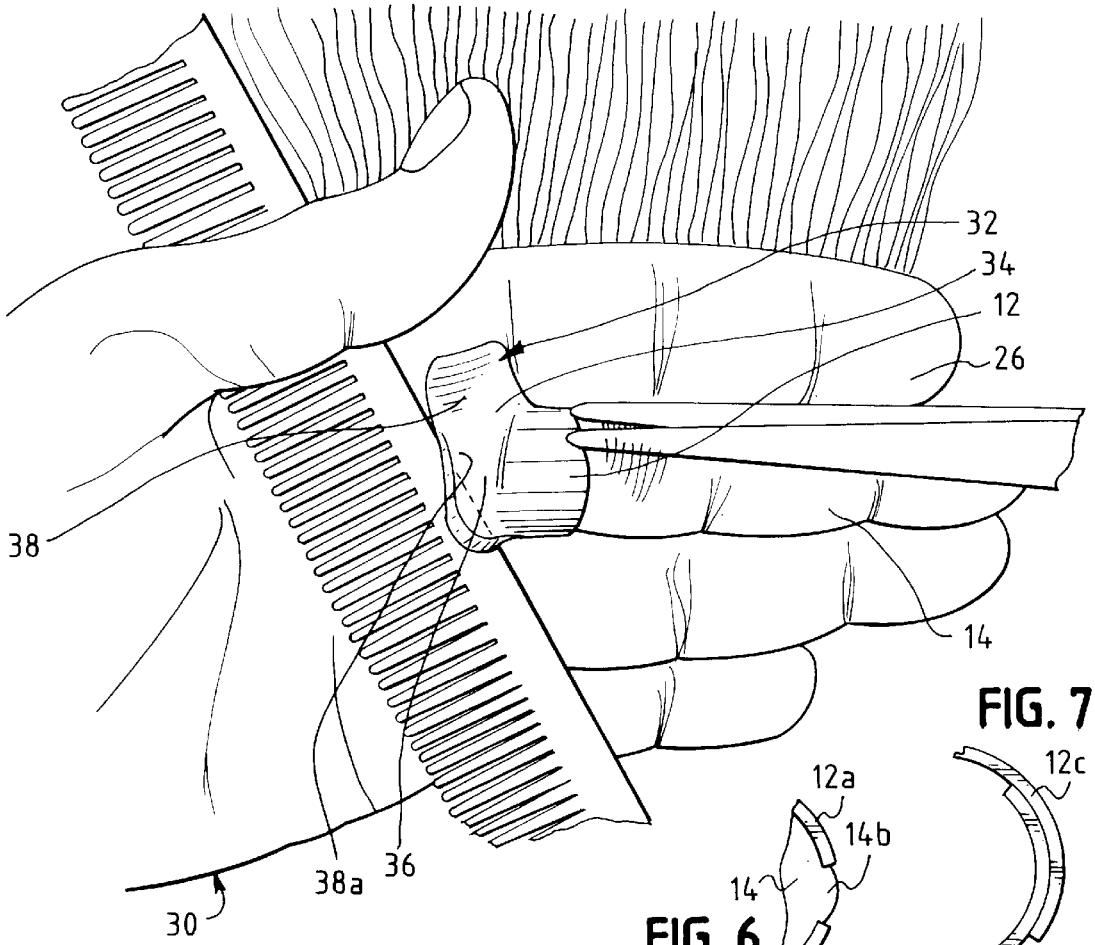
FIG. 7
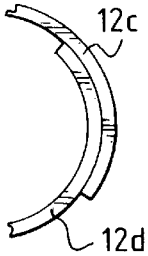
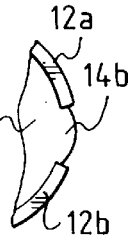
FIG. 6
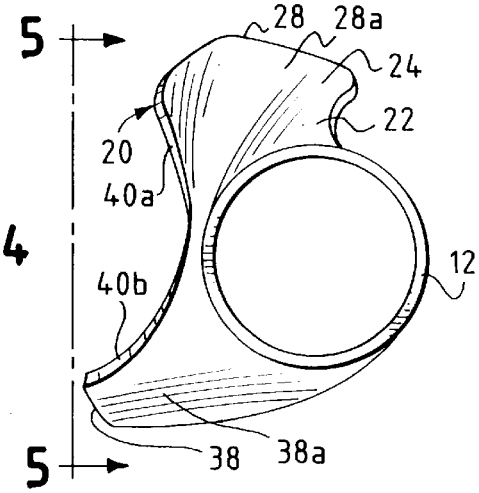
FIG. 4
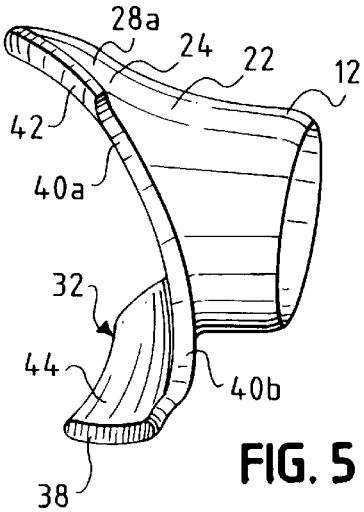
FIG. 5

BARBER'S PROTECTIVE RING

This invention relates to a ring to be worn while cutting another person's hair in order to protect the haircutter's fingers, knuckles and portions of his hand adjacent to the bases of his fingers from being nipped by the scissor blades. More particularly, it relates to a ring having one or more flanges appended to the band to keep the scissor blades, especially the tips, away from the skin of the haircutter's fingers, knuckles and web areas adjacent the bases of the fingers. Preferably, one of the ring flanges on the back side of the hand is flared out, like a paddle, over the web at the base of the finger on which the ring is worn and also over a portion of a finger adjacent to the ring-bearing finger. Preferably, as well, a second flange located on the palm side of the wearer's hand, is flared over an adjacent web area and finger base. Both flanges preferably include inwardly facing surfaces which match substantially the topography of the hand and finger portions which they overlie.

BACKGROUND OF THE INVENTION

Heretofore, a variety of finger and palm guards have been disclosed. One of them is shown and described in U.S. Pat. No. 5,363,508 issued Nov. 15, 1994 to Ok C. Kim. The guard is a pair of tubular members which fit over the middle and index fingers of a user's hand from about the middle joint to the base of the fingers. Both tubular members are connected by individual bellows to sheath-like leaves which overlap each other and are connected in about the same plane to each other by a rivet. The rivet connection permits the user's fingers to move naturally toward and away from each other.

Another guard is shown in U.S. Pat. No. 4,674,487 which issued Jun. 23, 1987 to Schaeffer. The guard is a helically shaped flat band. A portion of the band intermediate the ends of the band can be positioned on the inside of the middle knuckle of a user's middle finger. One end of the band is wrapped around the middle finger to overlie the knuckle at base of the middle finger on the back of the user's hand, while the other end of the band is wrapped around the distal portion of a user's middle finger and terminates with a tab which overlies the extended end of the user's middle finger.

Still another form of palm and finger guard is illustrated in U.S. Pat. No. 5,520,626, issued May 28, 1996 to Schaeffer. The guard is a disk-shaped plate which is dished, and in cross-section is a portion of a substantially spherical surface. A stem extends from an edge of the dish to a point on the edge of a ring shaped band for a barber to wear around the base of his middle finger. The band and stem hold the dish shaped plate over the fleshy part ofthe barber's hand adjacent the base of his middle finger. The stem may be slipped under the ring and positioned to hold the dish shaped plate over the exact places to be protected on the barber's hand, or the stem may be bent in order to position it more exactly and comfortably.

Other protective guards are shown in U.S. Pat. Nos. 4,689,828 to Brewer (a Y-shaped sleeve for two fingers, with a yoke and wrist-band for holding the sleeve in place); 4,097,931 to Hirose (a partial glove enclosing all but the tips of the wearer's first three fingers); 5,018,221 to Romandetto (a glove with a shock-absorbent material releasably attached to it on the front side or the back side of a joint); 5,081,715 to Mascia (a layered protective pad with straps holding it in place over the palm of a wearer's hand and wrist); 4,507,804 to Consigny (a bendable finger guard which includes resilient stems on either side of a finger to be protected and ovoidal lamellae pivotally connected to the stems to overlap one another all along the back of a finger); 4,908,881 to Field (a pliable sheath which is generally cylindrical and is applied over the distal portion of a finger to cover the fingertip and fingernail); and 5,450,626 to Sorrels (a flexible sleeve made into a tubular member to cover the middle and terminal phalanges of a finger or a thumb, with hood-like extensions at each end on the dorsal side extending in one direction to the end of the finger and in the other direction to the end of the finger's medial joint).

In contrast to the foregoing, it is one of the objects of this invention to provide a ring made of rigid material such as metal which a barber can conveniently slip on to protect the skin along the metacarpal knuckles of the fingers which he uses to lift strands of hair for cutting from being nipped by his scissors.

It is a further object of this invention to provide a ring made of rigid material such as metal which a barber can conveniently wear to protect the fleshy part of his palm adjacent the bases of the fingers which he uses to lift strands of hair for cutting from being nipped by his scissors.

It is a further object of this invention to provide a protective ring which a barber can conveniently slip on and wear throughout the entire time of cutting a client's hair without limiting the movements of the fingers which he uses to lift strands of hair to be cut.

It is a further object of this invention to provide a protective ring made of rigid material such as metal which a barber can wear on one finger having flanges which are contoured to the knuckles areas adjacent to the bases of the fingers which he uses to lift strands of hair for cutting and also contoured to the fleshy palm side of those fingers adjacent the metacarpal knuckles.

It is a further object of this invention to provide a protective ring which combines the functions of protecting the skin of the barber's knuckles and palm adjacent to the bases of the fingers which he uses to life strands of hair for cutting, and also of providing the full range of finger movement which a ring band at the base of one finger permits, as well as the decorativeness which a contoured, sculptured ring gives to a viewer.

It is a further object of this invention to provide a protective ring made of rigid material such as metal for a barber to use which is equally easy to store in a drawer with the rest of the barber's tools and also to put on one's hand when it is time to give a client a haircut.

SUMMARY OF THE INVENTION

The present invention is a barber's protective ring made of a rigid material such as metal with a contoured flange either overlying the web at the base of the fingers which the barber uses to lift strands of hair to be cut, and guiding his scissors above the metacarpal knuckles of those fingers so that the scissors will not close on the skin of the knuckles, or overlying the fleshy palm side of the barber's hand adjacent the same knuckles to guide his scissors away from his palm. Preferably, the ring has such flanges on the dorsal side of the barber's hand and also on the palm side of his hand. Preferably also, the flanges are integrally formed with the ring band so that the ring is a rigid unit, although other means, such as hinges, may be used for joining one or more of the flanges to the band.

Other aspects and advantages of this invention will be apparent from an examination of the accompanying drawings and the following detailed description.

BRIEF DESCRIPTION OF THE DRAWINGS

FIG. 3 is a perspective view of the palm side of a barber's hand during a haircutting process showing the palm side view of the protective ring of FIG. 1 on the middle finger of the barber's left hand, but with the tips of the barber's scissors in position to cut strands of hair on the palm side of the barber's hand;

FIG. 4 is a top view in perspective of the barber's protective ring shown in FIG. 1;

FIG. 5 is a side view in perspective of the barber's protective ring shown in FIG. 4 taken in the direction of the arrows 5—5 in FIG. 4;

FIG. 6 is a fragmentary view of a modified portion of the barber's protective ring shown in FIG. 5; and FIG. 7 is a fragmentary view of the barber's protective ring shown in FIG. 5 showing an alternate modification of the fragmentary portion shown in FIG. 6.

DETAILED DESCRIPTION OF THE PREFERRED EMBODIMENTS

Figure 1:
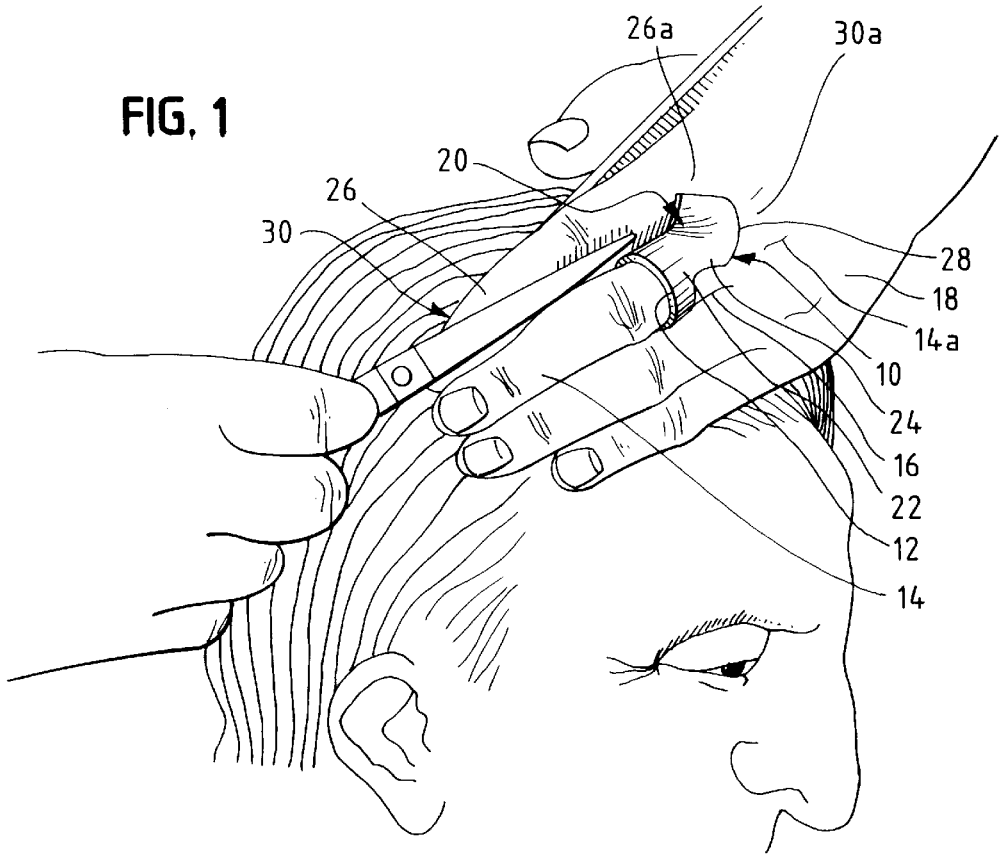
FIG. 1 is a perspective view of the dorsal side of a barber's hand during a haircutting process showing the protective ring of this invention on the barber's middle finger of his left hand.

The barber's protective ring 10 shown in FIGS. 1–5 includes a band portion 12 which is adapted to engage a wearer's central finger 14 adjacent the base 16 of that finger and the metacarpal body 18 of the wearer's hand. A first flange portion 20 is joined to band portion 12 through a first end section 22. A body section 24 of the first flange 20 is connected to the first end section 22, and it overlies both a portion of central finger 14 and a portion of neighboring finger 26. A second end section 28 of the first flange 20 is connect to body section 24. The outside surface 28*a* (see FIGS. 4 and 5) of the second end section 28 of ring 10 is spaced apart from the wearer's hand 30 adjacent the metacarpal knuckle 32*a* of central finger 14 and metacarpal knuckle 26*a* of neighboring finger 26. As is apparent in FIG. 1, the first flange portion 20 of ring 10 depends from band portion 12 and is arranged over the back side 30*a* of the wearer's hand 30. A second flange portion 32, soon to be more fully described, depends from band portion 12 similarly to the first flange portion 20 but is arranged on the palm side 30*b* of the wearer's hand 30.

As is also apparent, ring 10 may be made with only one flange portion, such as first flange portion 20 or second flange portion 32, or may be made with both the first and second flange portions 20 and 32 depending from the band portion 12.

The second flange portion 32 includes a first end section as shown, for example, in FIG. 3 at 34, connected to the band portion 12 of ring 10. A body section 36 is connected to the first end section 34 and is arranged to overlie a portion of the central finger 14 on the palm side 30*b* of the wearer's hand. The body section 36 also overlies a portion of neighboring finger 26 adjacent the base of that finger on the palm side of the wearer'hand. A second end section 38 of the second flange 32, separated from first end section 34 by body section 36 to which second end section 38 is connected, presents an outside surface, i.e., a surface 38*a* spaced apart from the skin of wearer's hand by the thickness of the material from which the ring is formed. In this manner, the surface 38*a* is spaced apart from the fleshy surface of the inside of the wearer's hand adjacent the metacarpal knuckles of the central finger 14 and neighboring finger 26 and keeps the wearer from nipping himself with the tips of his scissors.

A first edge portion 40*a* along one side of first flange portion 20 is disposed adjacent to the wearer's neighboring finger 26. The first edge portion 40*a* extends from the second end section 28 of first flange portion 20 toward the band portion 12 in an arcuate manner and forms a saddle along edge 40*a* for receiving one side of the wearer's neighboring finger 26. Similarly, a second edge portion 40b along one side of second flange portion 32 is disposed adjacent to the wearer's neighboring finger 26. The second edge portion 40*b* extends from the second end section 38 of second flange portion 32 in an arcuate manner and joins first edge portion 40*a*. Together the first and second edge portions 40*a* and 40*b* form an elongated saddle for receiving a substantial portion of the inner side of neighboring finger 26.

Both the first flange portion 20 and the second flange portion 32 are provided with inner faces which are contoured to the surface portions of a wearer's hand which, respectively, they overlie. In the case of first flange portion 20, inner face 42 (see FIG. 5) is contoured to reciprocally fit into the valley in the back of a wearer's hand adjacent the back portion 12 of ring 10 and at the base of the central finger 14 and neighboring finger 26. In the case of the second flange portion 32, inner face 44 is contoured to reciprocally fit over the fleshy surface of the palm side of a wearer's hand adjacent the band portion 12 of ring 10 and at the base of central finger 14 and neighboring finger 26.

Ring 10 provides the wearer with the flexibility of movement which a narrow band around just one finger affords while at the same time provides a shield for the front and back of the wearer's hand for all of the areas which tend to get scissor cuts. The width of the band portion 12 of ring 10 is narrower than the distance from the base of a wearer's central finger 14 to the adjacent phalangeal knuckle 46 (see FIG. 2). The first end section of flange portion 20, i.e., first end section 22, and the first end section of second flange portion 32, i.e., first end section 34, are each integrally formed with band portion 12. The flange portions, when two ofthem are utilized, are in fixed relation to each other along the band portion 12 of ring 10 and fit naturally over the outside and inside of the wearer's hand. Preferably, the band portion and the flange portions are formed as a unit which is made of metal or plastic so that the entire unit resists being cut by the user's scissors. However, other cut-resistant materials may be used to accomplish deflection of the scissor blades away from a user's palm, fingers and knuckles.

In order to accommodate a variety of circumferential finger sizes, the band portion 12 may be made with separated, opposed end sections of the band portion 12 on the palm side of the wearer's finger as shown in FIG. 6. The separated, opposed ends 12*a* and 12*b* of band portion 12 may be spaced apart from each other so that one side 14*b* of the ring bearing finger 14 protrudes into a gap between the separated ends, or, as shown in FIG. 7, ends 12*c* and 12*d* of band portion 12 may be overlapped if the cut-resistant material from which the ring is made is supple enough to permit the ends of the band portion 12 to move slightly and enlarge its diameter.

Figure 2:
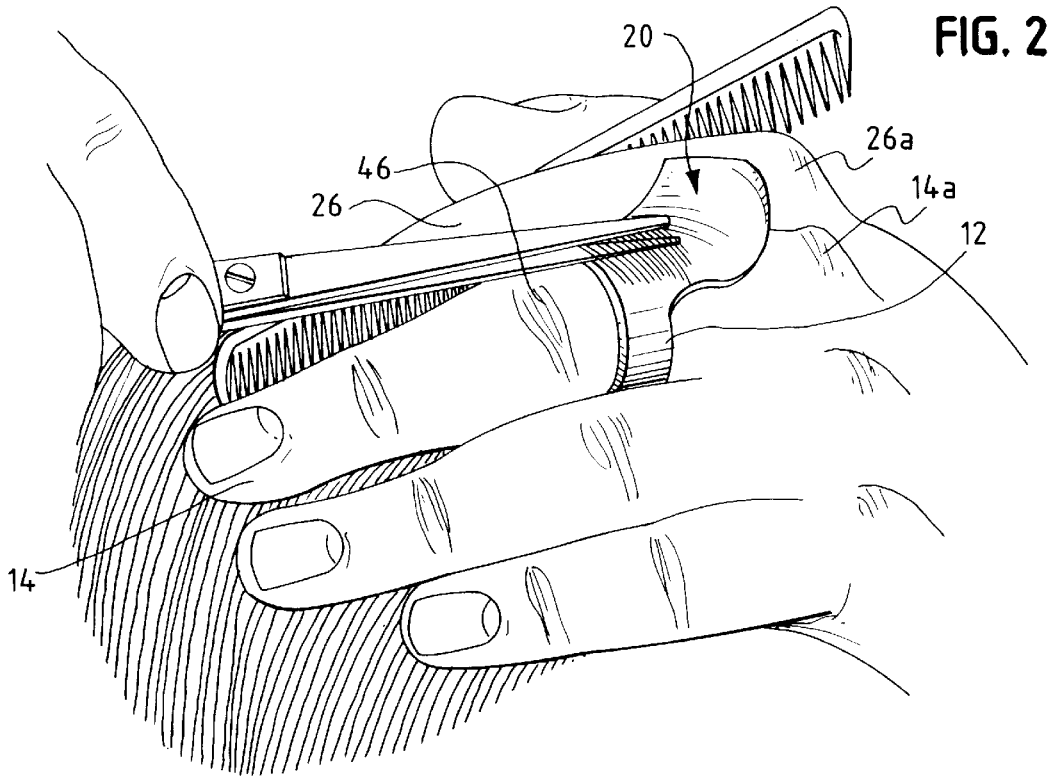
FIG. 2 is an enlarged perspective view of the protective ring on a barber's left hand in the attitude as shown in FIG. 1, but with the tips of the barber's scissors slightly separated over the ring in the haircutting process shown in FIG. 1.

As shown in FIGS. 1, 2 and 3, a barber who is right handed may wear the protective ring 10 on the middle finger of his left hand and grasp strands of hair to be cut between the first and middle fingers of that hand, i.e., fingers 14 and 26. The thickness of the ring material and the contours and disposition of the band and flange portions protect the middle and first finger knuckles 14*a* and 26*a* from being nipped by the barber's scissors and also protect the fleshy skin on the palm side of his hand adjacent the base ends of those fingers.

The embodiments of this invention which are described above may be embraced in other specific forms without departing from the spirit or essential characteristics of the invention. The described embodiments are, therefore, to be considered in all respects as illustrative and not restrictive, the scope of the invention being indicated by the claims rather than by the foregoing description. Accordingly, all changes which come within the meaning and range of the equivalents of the claims are intended to be covered therein.

I claim:

1. A barber's guard ring comprising a band portion adapted to engage a wearer's central finger adjacent the base of the finger and the metacarpal body of the wearer's hand, and at least one protective flange portion including a first end section connected to the band portion, a body section connected to the first end section and arranged to overlie a portion of the central finger and a portion of a neighboring finger, and a second end section connected to the body section and having an outside surface adapted to be spaced apart from the wearer's hand adjacent the metacarpal knuckles of the central finger and the neighboring finger when worn, the flange portion also including a first edge portion adjacent the neighboring finger extending from the second end of said flange toward the band portion of the ring and forming a saddle along said edge portion for receiving one side of the neighboring finger.

2. The guard ring of claim 1 in which the flange portion depends from the band portion and is arranged over the back side of the wearer's hand.

3. The guard ring of claim 1 in which the flange portion depends from the band portion and is arranged on the palm side of the wearer's hand.

4. The guard ring of claim 1 in which the width of the band portion is narrower than the distance from the base of a wearer's central finger to the adjacent phalangeal knuckle of said finger.

5. The guard ring of claim 1 in which the first end section of the flange portion is integrally formed with the band portion.

6. The guard ring of claim 1 in which the band portion includes a pair of opposed end sections separated from each other.

7. A barber's guard ring comprising a band portion adapted to engage a wearer's central finger adjacent the base ofthe finger and the metacarpal body of the wearer's hand, and at least a pair of protective flange portions, one arranged on the back side of the wearer's hand and one arranged on the palm side of the wearer's hand, each flange portion including a first end section connected to the band portion, a body section connected to the first end section and arranged to overlie a portion of the central finger and a portion of a neighboring finger, and a second end section connected to the body section and having an outside surface spaced apart from the wearer's hand adjacent the metacarpal knuckles of the central finger and the neighboring finger.

8. The guard ring of the claim 7 in which the flange for the back side of the wearer's hand includes a first edge portion adjacent the neighboring finger extending from the second end of said flange toward the band portion of the ring and forming a saddle along said edge portion for receiving one side of the neighboring finger.

9. The guard ring of claim 8 in which the palm side flange includes a second edge portion extending from the second end of the palm side flange and joining the first edge portion of the flange for the back side of the wearer's hand, said first and second edge portions forming a saddle for receiving one side of the neighboring finger.

10. The guard ring of claim 7 in which each flange includes a contoured face reciprocally fitted to the surface of the wearer's hand adjacent the band portion of the ring and the base of the wearer's central and neighboring fingers.

11. The guard ring of claim 7 in which the band portion and the flange portions are in fixed relation to each other and formed of a cut-resistant material.

* * * * *